US006643983B2

(12) United States Patent
Mazure

(10) Patent No.: US 6,643,983 B2
(45) Date of Patent: Nov. 11, 2003

(54) CLADDING DEVICE FOR THE POND OF A SWIMMING POOL OR THE LIKE

(75) Inventor: Patrick Mazure, Frans (FR)

(73) Assignee: Enterprise Mazure Patrick, Societe en nom personnel, Frans (FR)

( * ) Notice: Subject to any disclaimer, the term of this patent is extended or adjusted under 35 U.S.C. 154(b) by 0 days.

(21) Appl. No.: 10/062,582

(22) Filed: Jan. 31, 2002

(65) Prior Publication Data

US 2002/0100230 A1 Aug. 1, 2002

(30) Foreign Application Priority Data

Feb. 1, 2001 (EP) ..... 01440023

(51) Int. Cl.[7] ..... E04B 2/00; E04B 9/00; E04B 4/00

(52) U.S. Cl. ..... 52/169.7; 52/506.01; 4/487; 4/488

(58) Field of Search ..... 52/169.7, 396.05, 52/396.1, 506.01, 508; 4/487, 488

(56) References Cited

U.S. PATENT DOCUMENTS 2,363,429 A * 11/1944 Lowry ..... 52/396.05
3,633,546 A * 1/1972 Guttag ..... 119/245
4,106,246 A * 8/1978 LaFountaine ..... 52/169.7
4,407,102 A * 10/1983 Boyack ..... 52/169.7
4,409,772 A * 10/1983 Boyack ..... 52/746.1
4,768,322 A * 9/1988 Kafarowski ..... 52/235
4,948,296 A * 8/1990 Salter ..... 405/55
5,239,798 A * 8/1993 Saito ..... 52/235
5,330,151 A * 7/1994 Boyack ..... 249/83
5,649,399 A * 7/1997 Kepets ..... 52/396.06
5,657,602 A * 8/1997 Hellander ..... 52/446
5,763,090 A * 6/1998 Boe ..... 428/426
5,829,216 A * 11/1998 Newcomb et al. ..... 52/395
6,374,561 B1 * 4/2002 Ishiko ..... 52/506.01

* cited by examiner

*Primary Examiner*—Carl D. Friedman
*Assistant Examiner*—Kevin McDermott
(74) *Attorney, Agent, or Firm*—Harrison & Egbert

(57) ABSTRACT

A cladding device for the pond of a swimming pool or the like includes a slab as well as side walls made of concrete or the like. This device is characterized in that it is formed of tightly juxtaposed glass plates applied, through mounting mechanisms, against the slab and the side walls of the pond, on the inner side of the latter.

13 Claims, 2 Drawing Sheets

CLADDING DEVICE FOR THE POND OF A SWIMMING POOL OR THE LIKE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to a cladding device for the pond of a swimming pool or the like comprised of a slab as well as of side walls made of concrete or the like.

This invention relates to the field of the manufacture and/or renovation of a pond, in particular that of a swimming pool, namely a private swimming pool, an aquarium or the like.

BACKGROUND OF THE INVENTION

There are already known such ponds, namely implanted at the level of an excavation, and defined by a slab bordered by side walls, such a pond being generally made of concrete or the like.

This pond is usually completed with a cladding of a waterproof type that covers the concrete and is aimed at impeding water from leaking out of this pond. In a complementary way, this cladding can also contribute to the esthetic nature of said pond by ensuring an enhancement of the latter.

Thus, it is known to carry out such a cladding by applying, through gluing, the pieces of a filing or mosaic on the concrete of said pond. In this respect one should note that such an embodiment results into a particularly high cost price of such a pond. In addition, the glue capable of ensuring the adhesion of the tiles or the mosaic suffers from degradations in the course of time, which causes water to leak at the level of the concrete.

Another embodiment consists in applying on the concrete of the pond a synthetic waterproof coating formed, e.g., by a resin layer spread over this concrete. The spreading of this resin is a tiresome work and often results into a non-constant thickness, even lacks of it at the level of the applied layer.

Such a coating can also be formed by a film in the form of rolls of a determined width, which are unwound over the surface of the concrete of the pond and which are welded edge to edge, in order to achieve the tight nature. In the course of time, the coating weakens in particular at the level of these welding seams.

The non-homogeneity of the thickness of the resin layer, the lacks of it at the level of the latter as well as the weakening of the welding seams result into leaks that are particularly difficult to be localized and which are difficult to be repaired.

BRIEF SUMMARY OF THE INVENTION

The present invention is aimed at coping with the drawbacks of the cladding devices of the state of technique.

To this end, this invention relates to a cladding device for the pond of a swimming pool or the like comprised of a slab as well as of side walls made of concrete or the like, characterized in that said cladding device is formed of tightly juxtaposed glass plates applied through mounting means, against the slab and the side walls of said pond, on the inner side of the latter.

According to an embodiment the mounting means are defined by a frame, on the one hand, defined by an assembly of profile bars taking the shape of an angle iron, on the other hand, inside which a glass plate is inserted and tightly fixed and, furthermore, provided or designed so as to be capable of co-operating with means allowing fixing it at the level of the slab and/or of a side wall of said pond.

According to another embodiment the mounting means are defined by a frame formed of an assembly of profile bars, namely of a metallic type, fixed to the slab and/or to a side wall of the pond, against this frame being inserted said glass plates.

Another feature consists in that two adjacent plates are juxtaposed at the level of a profile bar extending longitudinally with respect to the juxtaposed edges of said plates.

In fact, two adjacent plates, which clad as the case may be, the slab or a side wall, are inserted above a profile bar fixed to said slab or to said side wall.

However, at the level of the union between the slab and a side wall, the frame includes at least one profile bar taking the shape of an angle iron against which is inserted a first glass plate cladding said slab and defining, in combination with said angle iron, means for encasing a second glass plate cladding a side wall.

According to another feature, the mounting means also include at least one fixing organ taking the form of a fastening lug, on the one hand, made integral with a profile bar of the frame and, on the other hand, designed so as to be capable of cooperating with the edge of at least one glass plate, at the upper portion of the latter, in order to fasten and/or to maintain such a plate at the level of a side wall of the pond.

According to another feature, between two juxtaposed glass plates is defined a gap into which is inserted a fir-type seal coated with a silicone-type seal.

An additional feature consists in that the mounting means also include a compressive seal inserted against said profile bar and including means forming suction pads designed so as to be capable of co-operating with at least one glass plate, in order to ensure an immobilization of the latter on said profile bar.

Another feature is that each glass plate is defined by a superposition of at least two glass plates, preferably separated by a reinforcing element, namely a shielded, armored or laminated glass plate.

According to an additional feature, such a glass plate is of a transparent type and completed with an enameled or lacquered-glass film, layer or plate having, as the case may be, particular patterns and/or a particular color.

Another feature is that the cladding device includes optical means capable of creating light effects or of transmitting a particular illumination light, such means being arranged at the level of the slab or of a side wall of the pond even interposed between the latter and said cladding device.

In fact, such a glass plate can be completed with an anti-slip coating.

The advantages of this invention reside in that the cladding device is formed of juxtaposed glass plates.

In this respect, one should note that glass is a material that is particular resistant to chemical (cleaning and maintenance products for a swimming pool or the like . . . ) and physical attacks (maintenance equipment objects of any kind entering into contact, whether intentionally or not with the glass . . . ).

In addition, cladding a pond by means of a glass material considerably facilitates the maintenance of a swimming pool or the like, namely because this material does not require particular precautions to be taken or a specific equipment to be used to clean it.

One should note that these glass plates are inserted against a frame comprised of profile bars, this through means authorizing an easy and individual removal of each plate, namely with a view to its replacing.

The present invention will be better understood when reading the following description, with reference to the attached drawings.

DETAILED DESCRIPTION OF THE INVENTION

Figure 2:
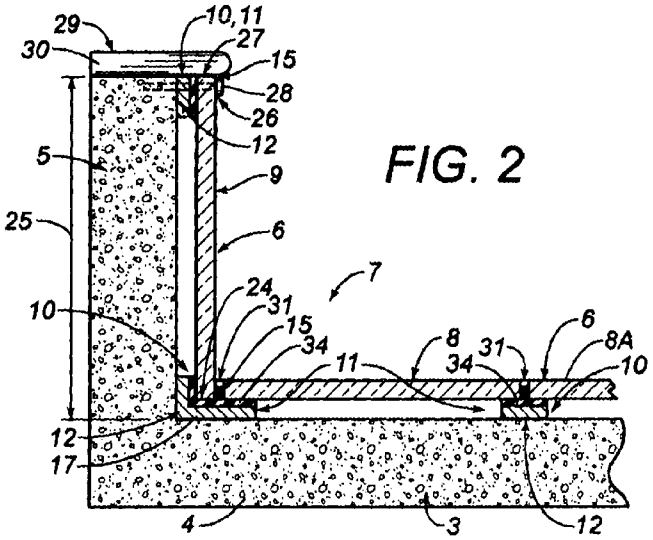
FIG. 2 is a schematic view corresponding to a cross-section along II—II of the pond shown in FIG. 1.

The present invention relates to the field of the manufacture and/or the renovation of a pond aimed at containing water and its object is a cladding device for such a pond.

One should note that in the further description reference will be made more in particular to a cladding device for a swimming pool. It is obvious that this corresponds to a particular application of this invention, whereby it must be understood that the latter is in no way limited to such a swimming pool and that it can also be used in a pond of another type, namely an ornament pond, a tank, an aquarium or the like.

As can be seen in the figures of the attached drawings, this invention relates to a pond 1, namely that of a swimming pool 2 or the like.

In fact this pond 1 is comprised, on the one hand, of a slab 3, namely defined by a preferably reinforced poured concrete 4 and, on the other hand, by side walls 5 defined by a masonry or by a concrete 4, namely similar to that forming said slab 3.

As known per se, such a pond 1 is usually completed with a device 6 allowing ensuring a cladding of this pond 1 on its inner side 7. Such a cladding device 6 forms a waterproof barrier aimed at retaining the water poured into the swimming pool 2 by impeding any water leakage.

According to the invention, said cladding device 6 is comprised of glass plates 8, 9 aimed at forming the cladding, for some 8 of them, of the slab 3 and, for the other ones 9, of a side wall 5 of the pond 1.

These glass plates 8, 9 are designed so as to be capable of being tightly juxtaposed and inserted, through mounting means 10, against the slab 3 and the side walls 5 of said pond 1, on the inner side 7 of the latter.

As can be seen in the figures of the attached drawings, the mounting means 10 are defined by a frame 11, made integral with the slab 3 and the side walls 5 of said pond 1, and against which said glass plates 8, 9 are inserted.

In fact, this frame 11 is comprised of an assembly of profile bars 12 made integral, through fastening means 13, with the slab 3 and/or at least one side wall 5 of the pond 1.

Figure 3:
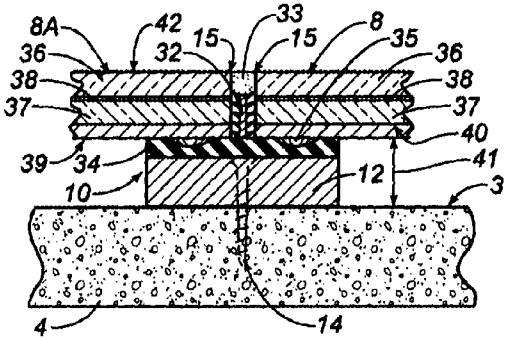
FIG. 3 is a schematic view of a detail corresponding to the juxtaposition of two plates inserted against a profile bar fixed to the slab of the pond.

Such fastening means 13 can be defined by anchoring means, namely in the form of a lug, aimed at being sealed at the level of said pond 1. However, according to a preferred embodiment which can be seen in FIGS. 3 and 4 of the attached drawings, such fastening means 13 are comprised of at least one fastening screw 14 capable of cooperating with the concrete 4 or the masonry of the pond 1.

One should note that such profile bars 12 are made out of a rigid corrosion-proof material, preferably a metallic material, namely of a rust-proof type, for instance aluminum or an aluminum alloy.

According to another feature of this invention, these profile bars 12 are implanted in a particular way at the level of said pond 1, so that two adjacent glass plates 8, 9, inserted against the frame 11, are juxtaposed at the level of such a profile bar 12.

Figure 1:
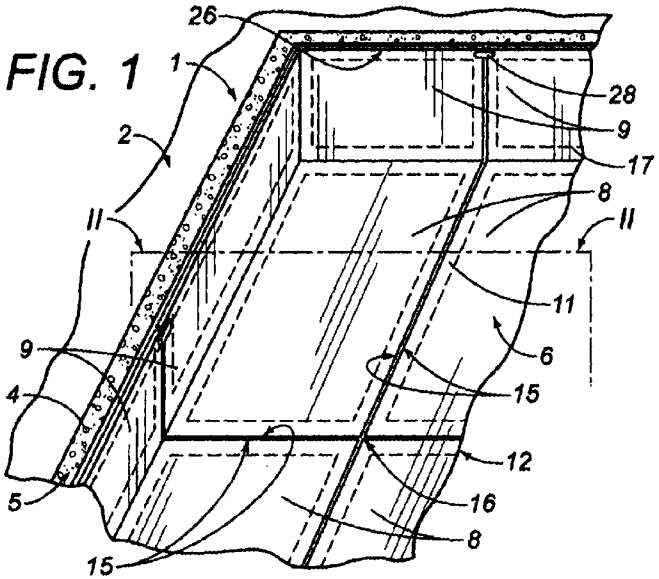
FIG. 1 is a schematic perspective and partly cross-sectional view of part of the pond of a swimming pool receiving a cladding device according to the invention.

More exactly, as can be seen in FIG. 1, such a profile bar 12 is implanted at the level of said pond 1 so that upon mounting the juxtaposed glass plates 8, 9 on the frame 11, this profile bar 12 extends longitudinally with respect to the juxtaposed edges 15 of these plates 8, 9.

In this respect one should note that such a profile bar 12 extends over at least a portion, but preferable over the full length, of the edge 15 of said juxtaposed glass plates 8, 9.

As can be seen in FIG. 1, the cladding device 5 includes a plurality of glass plates 8, 9 that are juxtaposed two by two, in the direction of both their length and their width. These plates 8, 9 then connect with each other at the level of a junction nod 16 at the level of which at least a profile bar portion 12 is provided for.

According to a preferred embodiment of the invention, such a profile bar 12 is capable of extending between two side walls 5 located in front of each other, this over the full length or over the full width of the pond 1 and at the level of the slab 3 of the latter. In such a case, said profile bar 12 can be comprised of several profile bar lengths 12, namely joined end to end or between which is arranged a profile bar 12 that is for example perpendicular to them.

In FIG. 2 is also shown a partly cross-sectional view of the pond 1 as well as of the device 6 capable of ensuring the cladding of the latter. In this figure, one should note that the slab 3 of this pond 1 is clad with a plurality of glass plates 8, 8A juxtaposed above a profile bar 12 fixed to said slab 3, as shown more in detail in FIG. 3.

Figure 5:
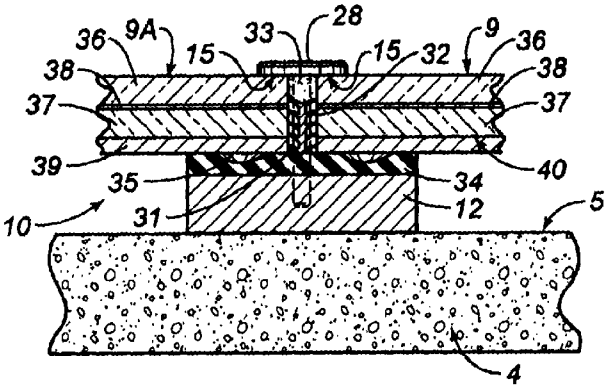
FIG. 5 is a schematic view similar to FIG. 3 and corresponds to the juxtaposition of two plates inserted against a profile bar fixed to a side wall of the pond.

In this respect one should note that in FIG. 5 has been shown the juxtaposition of two glass plates 9, 9A capable of ensuring a cladding of a side wall 5 of the pond 1. These glass plates 9, 9A are juxtaposed above a profile bar 12 fixed to the side wall 5 of said pond 1.

Figure 4:
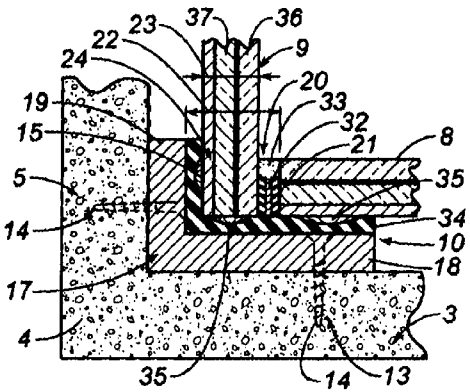
FIG. 4 is a schematic view similar to the previous one and corresponding to a detail of the juxtaposition of a plate cladding the slab and a plate cladding a side wall of the pond.

In FIG. 4, corresponding to a detail of FIG. 2, has been shown the juxtaposition between two glass plates 8, 9 ensuring the cladding of the slab 3 and of a side wall 5, respectively.

As can be seen in these same figures, these glass plates 8, 9 are then juxtaposed at the level of a profile bar 12 said frame 11 includes, such proffie bar 12 taking the shape of an angle iron 17, on the one hand, implanted at the level of the junction between the slab 3 and said side wall 5 and, on the other hand, fixed to at least one of the latter 3, 5.

Such an angle iron 17 includes a first wing 18, inserted against said slab 3, against which is inserted a first glass plate 8 cladding said slab 3.

Said angle iron 17 includes a second wing 19, inserted against said side wall 5, against which is inserted a second glass plate 9 cladding said side wall 5.

As can be seen in FIG. 4 corresponding to a preferred embodiment of the invention, this first glass plate 8 defines, in combination with said angle iron 17, means 20 for encasing said second glass plate 9.

This first glass plate 8 is indeed inserted against the first wing 18 of the angle iron 17 so that the end edge 21 of this first plate 8 is located at some distance 22 from the second wing 19, this distance 22 being larger than the thickness 23 of the second glass plate 9 at the level of its edge 15 at the end 24.

Such an embodiment authorizes, when placing this second glass plate 9 on the frame 11, an insertion through encasing of the edge 15 at the end 24 of this plate 9 between said first plate 8 and the second wing 19 of the angle iron 17. Upon insertion of the edge 15 at the end 24 of this second glass plate 9, the latter 9 is inserted against at least one profile bar 12 fixed to the side wall 5.

In this respect, one should note that the insertion of this second glass plate 9 allows immobilizing, even locking, laterally, said first glass plate 8 cladding the slab 3.

As can be seen in FIGS. 1 and 2, the glass plates 9 cladding a side wall 5 extend, preferably, over the full height 25 of this wall 5. In this respect, one should note that the frame 11 includes, at the upper portion of such a wall 5, at least one profile bar 12 against which such a glass plate 9 is aimed at being inserted.

Therefore, upon placing such a glass plate 9 at the level of the side wall 5, its fixing to the latter should be ensured.

A first embodiment consists in gluing this plate 9, namely by means of a silicone seal or the like, this at the upper portion 26 of this glass plate 9, in particular at the level of the upper edge 27 of the latter 9 and over its full length. Such a gluing occurs, preferably, to the profile bar 12 implanted at the upper portion of said side wall 5.

However, according to a preferred embodiment, the mounting means 10 for such a glass plate 9 also include at least one fastening organ 28 taking the form of a fastening lug, on the one hand, made integral with a profile bar 12 of the frame 11 and, on the other hand, designed so as to be capable of co-operating with the edge 15 of at least one glass plate 9, at the upper portion 26 of the latter.

Such a fastening lug 28 can adopt a L-shape and be made integral with a profile bar 12, as the case may be, implanted at the upper portion of said side wall 5 or above which are juxtaposed two glass plates 9, 9A.

This L-shaped fastening lug then co-operates with a glass plate 9 at the upper portion 26 of the latter, namely with its upper edge 27 or with its edge 15 at the level of which said plate 9 is contiguous to another glass plate 9A.

However, according to a preferred embodiment said fastening lug 28 adopts a T-shape and is made integral with a profile bar 12 above which two glass plates 9 are juxtaposed.

This T-shaped fastening lug 28 then co-operates with the two juxtaposed glass plates 9, 9A, at the upper portion 26 of the latter, namely in the vicinity of their upper edges 27 and, in particular, with their edges 15 at the level of which said plates 9, 9A are contiguous.

As can be seen in FIG. 2, said cladding device 6 can be completed with curbs 29, also formed of glass plates 30 and inserted, either directly or through a profile bar, at the level of the upper end of a side wall 5. Such a curb 29 can be so designed as to cover the upper edge 27 of a glass plate 9. One should note that the said fastening organ 28 is implanted namely below and, preferably, in the close vicinity of this curb 29.

Such a fastening organ 28 is capable of forming, in combination with the means 20 for encasing the lower end 24 of the glass plate 9, means for fastening the latter to a side wall 5 of the pond 1.

One should note that said fastening organ 28 is preferably so designed as to be capable of being removed, which allows, should such be necessary, proceeding to removing such a glass plate 9 with a view to its replacing.

As described above, two juxtaposed glass plates 8, 9 are inserted against the frame 11 at the level of namely above, a profile bar 12 this frame 11 includes.

One should note that between these two glass plates 8, 9 is defined a gap 31 that should be filled, in order to ensure the tightness of the cladding device 6.

Therefore, according to a preferred embodiment of the invention, into this gap 31 is inserted a fir-type seal 32 coated with a silicone-type seal 33.

Such an embodiment advantageously allows, should such be necessary, cutting out at least said silicone seal 33, in order to proceed to removing a glass plate 8, 9, namely with a view to its replacing.

According to another feature, the mounting means 10 also include at least one gasket 34 the profile bars 12 of said frame 11 are provided with. Such a gasket 34 is interposed between such a profile bar 12 and the glass plate or plates 8, 9 inserted against this profile bar 12.

Such a gasket 34 is of a compressive type and is inserted against said profile bar 12, namely through gluing.

This compressive gasket 34 includes means 35 forming suction pads designed so as to be capable of co-operating with at least one glass plate 8, 9, in order to ensure an immobilization of the latter against said profile bar 12.

In this respect one should note that these means 35 forming suction pads can be designed so as to ensure, alone, the immobilization of a glass plate 8, 9, namely under the action of the water pressure.

Thus, a glass plate 9 ensuring the cladding of a side wall 5 is capable of being immobilized against this wall 5 under the action of only these means 35 forming suction pads. In such a case, the fastening organ 28 can merely define an organ capable of retaining, should such be necessary, such a glass plate 9 when the pond 1 is emptied.

According to another feature of this invention, each glass plate 8, 9 is preferably defined by a superposition of at least two glass plates 36, 37.

The latter can then be made out of glass with properties of resistance specifically adapted to the pressure exerted namely by the water. A preferred embodiment consists in using diamond-type glass.

According to a preferred embodiment these glass plates 36, 37 can be separated by a reinforcing element 38.

The latter 38 can consist of a film of synthetic material or even of another glass plate, namely of a shielded armored or laminated type.

According to another feature, such a glass plate 8, 9 can be completed with means 30 capable of providing it a particular esthetic aspect namely in the form of particular patterns (grooves, sand grain aspect, sand waves, fauna or flora . . . ) and/or a particular color.

Such means 39 are for example in the form of a film, namely a synthetic film, applied on the surface of such a glass plate 8, 9, namely of a transparent or translucent type.

Another embodiment can consist in pot coloring such a plate 8, 9.

However, according to a preferred embodiment, such a glass plate 8, 9 is of a transparent type and completed with means 39 capable of providing it a particular esthetic aspect and defined by an enameled or lacquered-glass layer or even by an enameled or lacquered-glass plate having, as the case may be, particular patterns and/or a particular color (coloring, silver aspect . . . ).

Such a layer or such a plate is preferably applied at the level of the external face 40 of the glass plate 8, 9 oriented towards the pond 1 and not being into contact with the water.

These esthetic means 39 can also adopt the form of optical means capable of creating light effects or of transmitting a particular illumination light.

One should note that such optical means can also be arranged at the level of the slab 3 or of a side wall 5 of the pond 1. However, according to a particular embodiment these optical means are interposed between said pond 1 and said cladding device 6, in particular at the level of an interval 41 remaining between said pond 1 and the glass plates 8, 9.

Another feature consists in that the glass plates 8, 9, in particular those 8 cladding the slab 3, can be completed with an anti-slip coating 42, namely in the form of a synthetic film.

Figure 6:
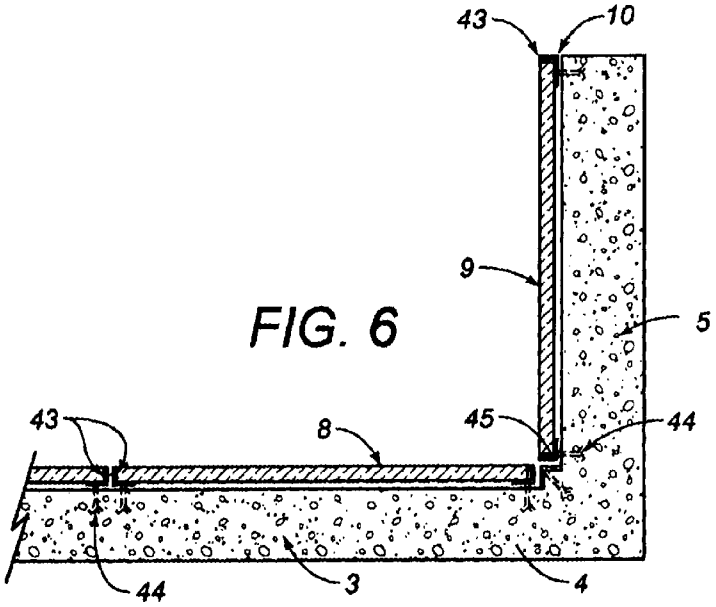
FIGS. 6 and 7 are schematic views similar to FIGS. 2 and 3 and correspond to another embodiment of the invention.
Figure 7:
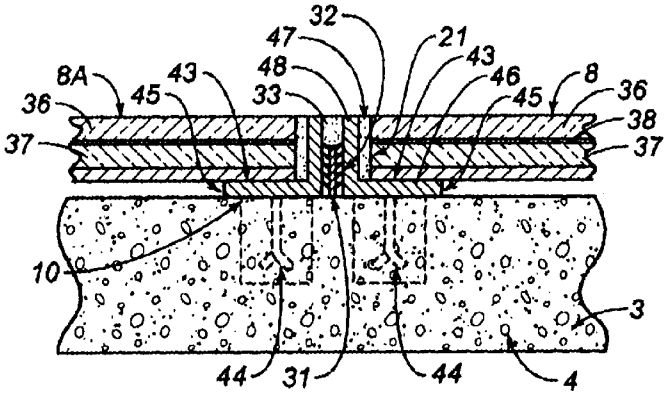

In FIGS. 6 and 7 has been shown another embodiment of the means 10 for mounting such glass plates 8, 9 on the slab 3 and on the side walls 5 of the pond 1.

These mounting means 10 are defined by a frame 43, namely of a metallic type, in which such a glass plate 8, 9 is set.

Such a frame 43 is provided or designed so as to be capable of co-operating with means 44 allowing its fixing at the level of the slab 3 and/or of a side wall 5 of said pond 1.

According to a preferred embodiment, such fastening means 44 are defined by anchoring means, namely in the form of a lug, associated to said frame 43 and aimed at being sealed at the level of the pond 1, namely in the concrete 4.

One should note that such a frame 43 can be defined by an assembly of profile bars 45 adopting the form of an angle iron in which a glass plate 8, 9 is inserted and tightly fixed.

The latter then applies against a first wing 46 of this angle iron that can advantageously be provided with a compressive gasket including means forming suction pads, as explained above.

The fixing of this glass plate 8, 9 to the frame 43 can be carried out by means of a silicone seal 47 interposed between the end edge 21 of this glass plate 8, 9 and a second wing 48 of the angle iron 45.

Such an embodiment allows, should such be necessary, cutting out the silicone seal 47, in order to allow removing the glass plate 8, 9 from its frame 43, with a view to proceed to its replacing.

According to another feature, two glass plates 8, 9 are juxtaposed in particular at the level of their frames 43. In this respect, one should note that between two juxtaposed frames 43 is defined a gap 31 that has to be tightly filled up, namely by inserting into it a fir-type seal 32 coated with a silicone-type seal 33.

I claim:

1. A cladding device for a swimming pool comprising:

a slab having a bottom surface with side walls extending upwardly from said bottom surface, said slab being formed of a concrete material;

a first glass plate;

a second glass plate;

a first mounting means for mounting said first glass plate to an inner side of said bottom surface of said slab; and a second mounting means for mounting said second glass plate to an inner side of the side wall of said slab, said first and second glass plates having respective edges tightly juxtaposed together.

2. The cladding device of claim 1, each of said first and second mounting means comprising:

a frame formed of an assembly of profile bars, each of said profile bars being an angle iron, the respective glass plate being inserted and tightly fixed within said frame; and fixing means secured to said frame, said fixing means for fixing the frame to said slab.

3. The cladding device of claim 1, said first mounting means comprising a first frame formed of an assembly of metallic profile bars, said first glass plate inserted within said first frame, said second mounting means comprising a second fame formed of an assembly of metallic profile bars, said second glass plate inserted within said second frame.

4. The cladding device of claim 3, said first and second glass plates being contiguous with a profile bar extending longitudinally at the juxtaposed edges of said first and second glass plates.

5. The cladding device of claim 4, said first and second glass plates being inserted above said profile bar, said profile bar being fixed against said slab.

6. The cladding device of claim 4, said first frame having said profile bar at a juncture of the bottom surface and at least one of said side walls, and profile bar being an angle iron, said first glass plate residing against said angle iron.

7. The cladding device of claim 6, said second mounting means further comprising:

at least one fastening organ integral with said profile bar, the fastening organ being a fastening lug, the fastening organ being cooperative with an upper edge of said second glass plate so as to fix said second glass plate to the side wall.

8. The cladding device of claim 2, said first and second glass plates having a gap between adjacent edges thereof, said gap receiving a fir-type seal coated with a silicone seal therein.

9. The cladding device of claim 3, each of said first and second mounting means further comprising at least one compressive gasket positioned against the profile bar, each of said first and second mounting means further comprising suction pad means cooperative with the respective glass plate for immobilizing the respective glass plate against the profile bar.

10. The cladding device of claim 1, each of said first and second glass plates comprising a plurality of glass plates superposed together and having a reinforcing element interposed therebetween.

11. The cladding device of claim 1, at least one of said first and second glass plates being transparent and covered with an enameled or lacquered-glass layer.

12. The cladding device of claim 1, further comprising:

an optical means positioned on said slab, said optical means for creating a lighting effect in the swimming pool.

13. The cladding device of claim 1, at least one of said first and second glass plates having an anti-slip coating thereon.

* * * * *